US005794368A

United States Patent [19]

Kirby

[11] Patent Number: 5,794,368

[45] Date of Patent: Aug. 18, 1998

[54] PROTECTIVE COVER FOR SPIKED GOLF SHOES

[76] Inventor: Alan A. Kirby, 924 Portola, Del Ray Oaks, Calif. 93940

[21] Appl. No.: 848,163

[22] Filed: Apr. 29, 1997

[51] Int. Cl.[6] ..... A43B 5/00

[52] U.S. Cl. ..... 36/135; 36/7.5; 36/116

[58] Field of Search ..... 36/135, 7.1 R, 36/7.3, 7.4, 7.5, 116, 113, 72 A, 72 R

[56] References Cited

U.S. PATENT DOCUMENTS

| | | | |
|---|---|---|---|
| D. 249,908 | 10/1978 | Meinhart | D2/317 |
| D. 313,884 | 1/1991 | Beckley | D2/277 |
| D. 356,436 | 3/1995 | Sutton et al. | D2/914 |
| D. 359,612 | 6/1995 | Dykstra | D2/914 |
| 843,199 | 2/1907 | Doyle | 36/7.5 |
| 1,187,728 | 6/1916 | Paskett | 36/7.5 |
| 1,811,781 | 6/1931 | Degge | 36/7.5 |
| 2,032,052 | 10/1936 | Friedenberg | 36/7.3 |
| 2,076,316 | 4/1937 | Beals, Jr. | 36/7.5 |
| 2,958,963 | 11/1960 | Lougheed | 36/7.5 |
| 3,176,416 | 4/1965 | Seegert | 36/7.1 |
| 3,313,047 | 4/1967 | Svien | 36/135 X |
| 3,827,166 | 8/1974 | Goodman | 36/135 |
| 3,913,243 | 10/1975 | Arnold et al. | 36/135 |
| 4,856,599 | 8/1989 | Stammen | 36/113 X |
| 5,367,794 | 11/1994 | Adelstein et al. | 36/135 |

FOREIGN PATENT DOCUMENTS

| | | |
|---|---|---|
| 451278 | 8/1926 | Germany . |
| 81123 | 5/1919 | Switzerland . |
| 2265299 | 9/1993 | United Kingdom . |

*Primary Examiner*—B. Dayoan
*Attorney, Agent, or Firm*—Richard C. Litman

[57] ABSTRACT

An overshoe for a shoe whose soles have a plurality of extending spikes, cleats or similar surface engaging elements to protect surfaces from being disturbed or damaged by contacting such elements includes a two-layered substantially flat sole with a toe hold and a heel retaining member. The two-layered sole includes a soft upper layer interconnected to a hard lower layer, and is formed in an oblong generally rectangular configuration that is oversized relative to the soles of conventionally sized spiked sport shoes. The lower layer is sufficiently firm or tough enough to resist puncturing by spikes or cleats extending from a sole of a covered shoe, and is preferably made of hard rubber, so golf spikes will not penetrate the sole and scuff or mark putting greens. The upper layer is soft or flexible to accommodate depressions formed from spikes or cleats extending from a sole of a covered shoe, and is preferably made of soft rubber or foam. The oversized oblong two-layered sole possesses a particular color, such as black, white or others. The toe hold is formed in conjunction with a front portion of the lower layer. The heel retaining member includes two relatively elastic bands connected to a leather patch.

7 Claims, 2 Drawing Sheets

PROTECTIVE COVER FOR SPIKED GOLF SHOES

BACKGROUND OF THE INVENTION

1. Field of the Invention

The present invention relates to overshoes or covers to be worn over shoes whose soles have a plurality of extending spikes, cleats or similar surface engaging elements to protect surfaces from being disturbed or damaged by contacting such elements.

2. Description of the Prior Art

Shoes having extending spikes, cleats or similar surface engaging elements are conventionally worn by people who engage in sporting activities such as golf, baseball, football, etc. Golfers and caddies know that the ability of golf course personnel to maintain a desirable smoothness of golf course putting surfaces is adversely affected by the wide use of such shoes on the putting surfaces due to the occurrence of spike marks, scuffs, foot prints and compaction. Overshoes for minimizing damages to floors and shoe spikes are known.

U.S. Pat. No. 1,811,781, issued to Eugene R. Degge on Jun. 23, 1931, describes an overshoe employing an open sole and heel crossed by plural elastic elements to protect floors and shoe spikes from wear and deterioration. Degge does not suggest the use of a flat two-layered sole with mild tread in accordance with the present invention.

U.S. Pat. No. 2,032,052 issued to Stanley Friedenberg on Oct. 27, 1933, describes an overshoe employing a sole and heel with recesses to protect floors and shoe spikes from wear and deterioration. Friedenberg does not suggest the use of a flat two-layered sole or the use of a heel retaining member in accordance with the present invention.

U.S. Pat. No. 2,958,963, issued to James L. Lougheed on Nov. 8, 1960, describes an overshoe employing a sole and heel with a plurality of integrally formed internal ribs to prevent shoe spikes from piercing the sole and heel of the overshoe. Lougheed does not suggest the use of a flat two-layered sole in accordance with the present invention.

U.S. Pat. No. 3,176,416, issued to Henry A. Seegert on Apr. 6, 1965, describes the use of an overshoe with a sole, a heel and means to secure spiked shoes in the overshoe. Seegert does not suggest the use of a flat two-layered sole in accordance with the present invention.

U.S. Pat. No. 5,367,794, issued to Stephen Adelstein et al. on Nov. 29, 1994, describes the use of an overshoe having a sole and a heel to protect floors and shoe spikes. Adelstein et al. do not suggest the use of a flat sole, a toe hold and a heel retaining member in accordance with the present invention.

Other conventional overshoes are shown in U.S. Design Pat. Nos. 249,908, issued to Robert H. Meinhart on Oct. 17, 1978, U.S. Design Pat. No. 313,884, issued to Douglas C. Beckley on Jan. 22, 1991, U.S. Design Pat. No. 356,436, issued to John S. Sutton et al. on Mar. 21, 1995, U.S. Design Pat. No. 359,612, issued to Dick Dykstra on Jun. 27, 1995, Switzerland Pat. No. 81,123, published on May 1, 1919, German Pat. No. 451,278, published on Aug. 4, 1926, and Great Britain Pat. No. 2,265,299 A, published on Sep. 29, 1993. None of these overshoes suggest the particular overshoe configuration described by the present invention.

None of the above inventions and patents, taken either singly or in combination, is seen to describe the instant invention as claimed.

SUMMARY OF THE INVENTION

The novel overshoe has a substantially flat two layered sole which carries a toe hold shaped for receiving the toe portion of a shoe, and a heel retaining member for securing a shoe in the overshoe. The two-layered sole includes a soft upper layer interconnected to a hard lower layer. The lower layer is sufficiently firm or tough enough to resist puncturing by spikes or cleats extending from a sole of a covered shoe, and is preferably made of hard rubber, so golf spikes will not penetrate the sole and scuff or mark putting greens. The upper layer is soft or flexible to accommodate depressions formed from spikes or cleats extending from a sole of a covered shoe, and is preferably made of soft rubber or foam. The two-layered sole possesses a particular color, such as black, white or others. The two-layered sole is also substantially flat and is formed in an oblong generally rectangular configuration that is oversized relative to the soles of conventionally sized sport shoes having extending surface engaging elements, to eliminate spike marks, heel larks and foot prints on putting greens at golf courses. The heel retaining member is formed from two straps of soft expandable rubber or rubberized fabric connected to a soft patch, preferably leather, which in turn are connected near the rear end of the sole.

Accordingly, it is a principal object of the invention to provide an overshoe for a spiked shoe which includes a substantially flat two-layered sole with .; raised rib tread design to provide a non-slip surface.

It is another object of the invention to provide an overshoe which maintains the toe portion and heel of a spiked shoe in overlying relationship to the sole of the overshoe.

It is a further object of the invention to provide the two-layered sole in an oversized oblong generally rectangular shape to reduce manufacturing costs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
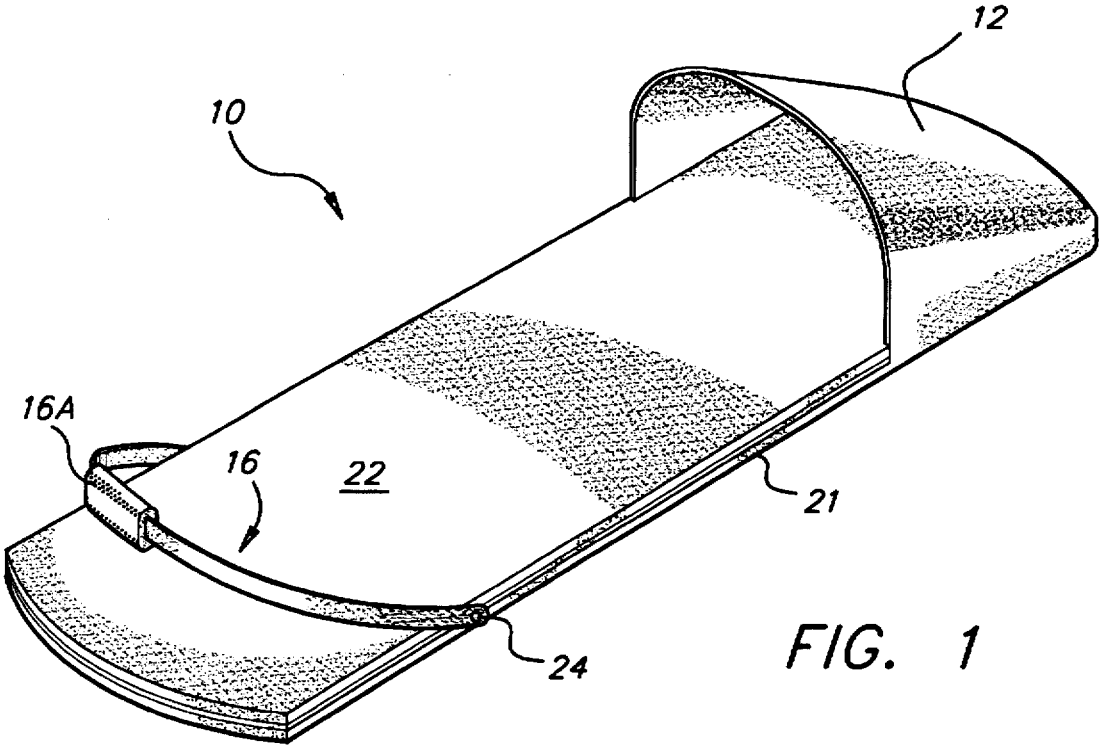
FIG. 1 is a perspective side view of an embodiment of an overshoe according to the invention from the rear left side.
Figure 2:
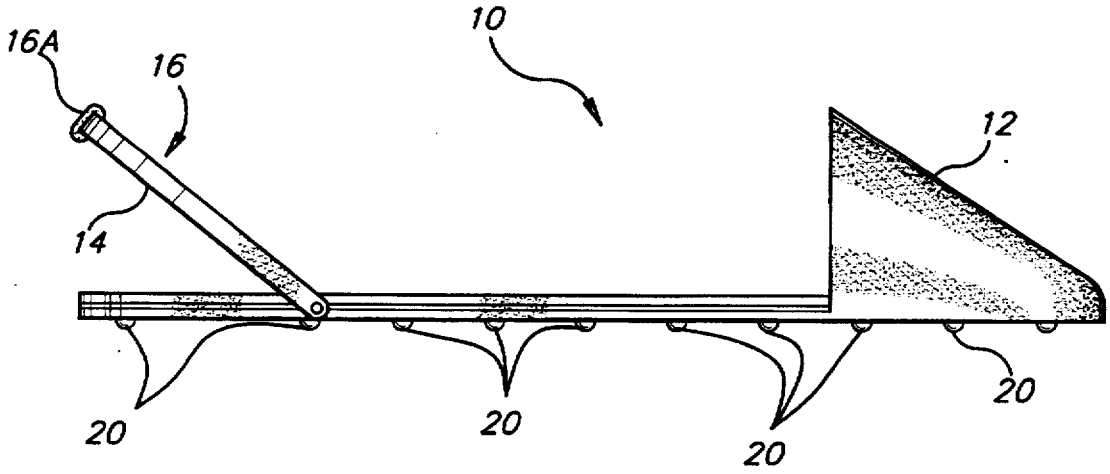
FIG. 2 is an elevational side view of the overshoe shown in FIG. 1.
Figure 3:
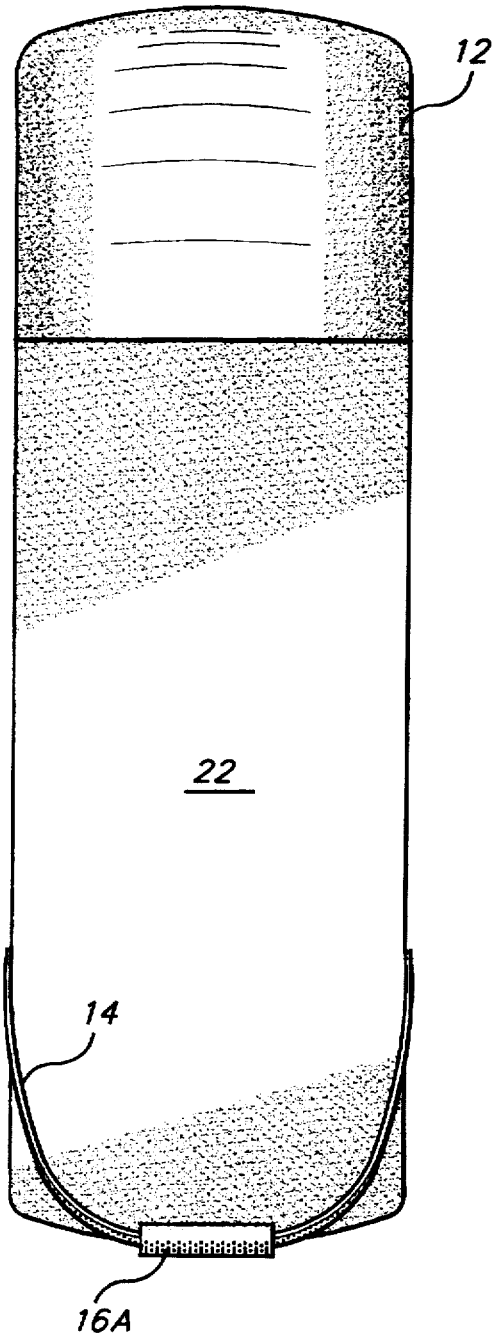
FIG. 3 is a top view of the overshoe shown in FIG. 1.

Referring now to the drawings, the present invention is an overshoe or cover 10 which is designed to slip on over a sport shoe having a sole including a plurality of extending spikes, cleats or similar surface engaging elements. The overshoe 10 includes a substantially flat sole 18 which carries a toe hold 12 shaped for receiving the toe portion of a shoe, and a heel retaining member 16 for securing a shoe with extending spikes or cleats in the overshoe.

Figure 4:
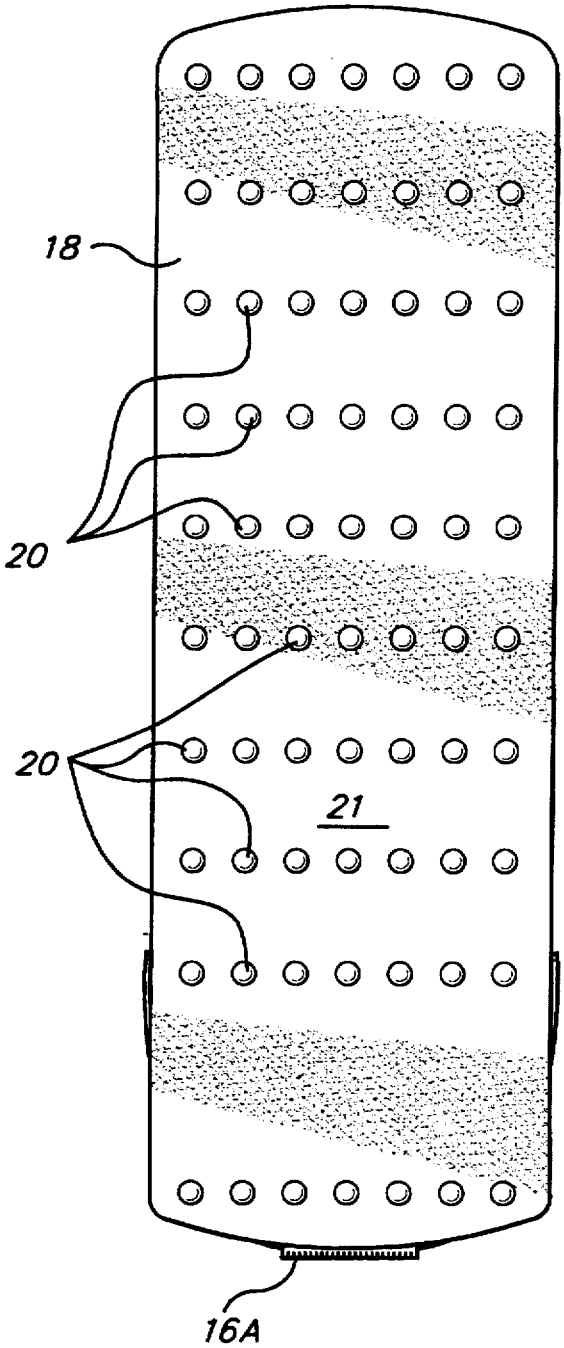
FIG. 4 is a bottom view of the overshoe shown in FIG. 1.

The sole 18 is formed with two layers, a lower layer 21 interconnected to an upper layer 22. The lower layer 21 is sufficiently firm or tough enough to resist puncturing by spikes or cleats extending from a sole of a covered shoe, and is preferably made of hard rubber, so golf spikes will not penetrate the sole and scuff or mark putting greens. Tread means, such as a plurality of 1/64 th inch raised ribs 20, are present on the external lower surface of the lower sole layer as best shown in FIG. 4, the ribs 20 are arranged in a patterned design substantially covering the external surface of the lower layer 21 to give the sole a non-slip surface. The upper layer is soft or flexible to accommodate depressions formed from spikes or cleats extending from a sole of a covered shoe, and is preferably made of soft rubber or foam. The two-layered sole 18 is substantially flat and is formed in an oblong generally rectangular configuration that is oversized relative to the soles of conventionally sized sport shoes having extending surface engaging elements to eliminate spike marks, heel marks and foot prints oil putting greens at golf courses. The oversized oblong shaped sole 18 also possesses a particular color, such as black, white or others. In addition, the oversized oblong shaped sole 18 reduce construction costs because the configuration of the overshoe 10 is the same and can be worn on either the right or left foot.

The toe hold 12 is peripherally connected to and bridges a front portion of the sole 18 to form an enclosure for receiving the toe portion of a spiked golf shoe. The toe hold also possesses a particular color, preferably the same or similar to the oversized oblong shaped sole 18, such as black, white or others. However, the toe hold 12 may also possess a color that is different from that of the oversized oblong shaped sole 18. The heel retaining member 16 is formed from two elastic straps 14 of soft expandable rubber or rubberized fabric connected to a soft patch 16A, preferably leather, and the rear end of the sole 18. The heel retaining member 16 pulls on behind a shoe heel to fasten the shoe in place in the overshoe 10, and can be molded with the overshoe in one piece or added to the overshoe after fabrication. Each of the straps 14 is connected at one end thereof to the sole 18 at connection point 24.

It is to be understood that the present invention is not limited to the sole embodiment described above, but encompasses any and all embodiments within the scope of the following claims.

I claim:

1. A protective cover for spiked golf shoes, comprising:

a substantially flat sole having a front portion and a rear portion, said sole being generally rectangular in shape and including a treaded external surface;

a toe hold peripherally connected to and bridging the front portion of said sole, said toe hold configured to form an enclosure for receiving a toe portion of a spiked golf shoe; and a heel retaining member connected to the rear portion of said sole, said heel retaining member including at least one elastic strap.

2. The protective cover according to claim 1, wherein said treaded surface includes a plurality of 1/64 inch raised ribs arranged in a patterned design.

3. The protective cover according to claim 1, wherein said heel retaining member comprises two elastic straps connected to a pliable patch.

4. The protective cover according to claim 3, wherein said two elastic straps are formed from rubber.

5. The protective cover according to claim 3, wherein said pliable patch is formed of a leatherized material.

6. The protective cover according to claim 1, wherein said sole and said toe hold are formed of rubber.

7. The protective cover according to claim 1, wherein said sole includes a flexible upper layer interconnected to a relatively firm lower layer.

* * * * *